US007857583B2

(12) United States Patent
Horng et al.

(10) Patent No.: US 7,857,583 B2
(45) Date of Patent: Dec. 28, 2010

(54) BASE DESIGN OF COOLING STRUCTURE

(75) Inventors: Alex Horng, Kaohsiung (TW); Tung Cheng Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 908 days.

(21) Appl. No.: 11/700,115

(22) Filed: Jan. 31, 2007

(65) Prior Publication Data

US 2008/0152486 A1 Jun. 26, 2008

(30) Foreign Application Priority Data

Dec. 25, 2006 (TW) ..... 95148824 A

(51) Int. Cl.
*F03D 11/00* (2006.01)

(52) U.S. Cl. ..... 415/203; 415/204

(58) Field of Classification Search ..... 415/102, 415/98, 213.1, 203, 204
See application file for complete search history.

(56) References Cited

U.S. PATENT DOCUMENTS 6,616,422 B2 * 9/2003 Hsieh ..... 417/354
2007/0222331 A1 * 9/2007 Horng et al. ..... 310/268

* cited by examiner

*Primary Examiner*—Edward Look
*Assistant Examiner*—Dwayne J White
(74) *Attorney, Agent, or Firm*—Alan Kamrath; Kamrath & Associates PA

(57) ABSTRACT

The present invention relates to a base design of cooling structure, which includes a base, and a shaft tube disposed on the base to support a spindle of an impeller to rotate therein. The base has at least a groove and the groove is located beyond an outer diameter; the groove design can be employed to effectively prevent the issue of contraction stress caused by difference of cooling time of temperature and to prevent a slanted shaft tube for supporting a stable operation of the spindle of the impeller, thereby avoiding the resulting run-out and noise, making vibration and noise test values of the product comply with a standard value range, reducing the defective rate of the product and prolonging the product lifespan.

19 Claims, 9 Drawing Sheets

BASE DESIGN OF COOLING STRUCTURE

FIELD OF THE INVENTION

The present invention relates to a base design of cooling structure, which can effectively prevent the center axis from being deviated due to the intrinsic stress out of thermal contraction of the base, so as to address a practical structure securing the quality and the lifespan of the product.

BACKGROUND OF THE INVENTION

As shown in FIG. 1, a conventional cooling structure includes a base 10 having an containing space 12 surrounded by a side wall 11 on a periphery thereof, an impeller and a stator set (not shown in FIG. 1, as the driving relationship between the impeller and the stator set is irrelevant to the subject of the present invention, both parts are not further depicted here), a shaft tube 13 disposed in the containing space 12, assembled or integrally formed on the base 10, providing a center bore for accommodating a bearing that supports a spindle of the impeller to rotate therein.

Whereas, when the base of the conventional cooling structure is formed by injection molding or die-casting, it is easily subjected to a contracted intrinsic stress and deformed, thus resulting in the following drawbacks;

slanted shaft tube: Depending on the position away from a sprue gate, regardless of a base formed by injection molding or die-casting, cooling time and temperature associated with a position of the base vary place by place. Hence, non-uniform contraction stresses arises from such difference, and the base of the conventional cooling structure is easily prone to a deformation resulting from the non-uniform contraction stresses, which gives rise to an oblique center line of the shaft tube.

large rotational run-out of impeller and large noise: As the base of the conventional cooling structure is easily subjected to the effect of the contraction stress, the shaft tube tends to be deflected and slanted. When the spindle of the impeller is supported by the central bearing inside the shaft tube, the impeller also exhibits a slanted condition. Consequently, when the impeller rotates, the slanted angle will make the impeller generate serious run-out, which also accompanies with a wind shear effect to generate enormous noise.

high product defective rate: When the impeller, because of the slanted shaft tube, generates serious run-out and enormous noise, the most direct impact is certainly a significant increase of product vibration and noise test value that sometimes even exceed a standard value range and thus result in a higher product defective rate.

short lifespan: When the impeller of the cooling structure is positioned in an environment with high run-out and high vibration amplitude for a long period of time, the life duration of the structure itself could be worn out seriously. Above all, the spindle and the bearing will be worn out much faster for withstanding the run-out and thus shorten the lifespan of the cooling structure.

As a consequence, to completely tackle the issue intrinsic to the above-mentioned conventional structure, a base design of cooling structure with a brand new idea must be aggressively conceived and developed to take both the quality and the lifespan of the product into account.

SUMMARY OF THE INVENTION

In view of the foregoing concern, the present invention thus provides a base design of cooling structure, including a base, a shaft tube disposed on the base, a bearing placed in a center bore of the shaft to support rotation of a spindle of an impeller, wherein the base has a groove located beyond the reach of an outer diameter of the shaft tube, the groove can be chosen to be disposed on both of a top and a bottom side respectively or on either one, and its form can be an annular shallow groove, a plurality of long-strip-like shallow grooves arranged as a ring, or a plurality of long-strip-like shallow grooves alternately arranged to form at least two rings.

The present invention employs the groove design to effectively prevent the non-uniform contraction stress caused by difference of cooling time and temperature and thus to prevent a slanted shaft tube so as to support stable rotation of the spindle of the impeller, and to avoid the issues of run-out and noise, thereby ensuring that vibration and noise test value of the product comply with a standard value range, the product defective rate is lowered and the lifespan of the product is prolonged at the same time.

DETAILED DESCRIPTION OF THE PREFERRED EMBODIMENT

The present invention relates to a base design of cooling structure, including a groove disposed on the base, in which the groove is located beyond the reach of an outer diameter of a shaft tube. The groove design is employed to effectively prevent the impact of thermal contraction stress on the shaft tube and prevent the shaft tube from tilting to enhance the quality and the lifespan of the product.

Illustrated are few preferred embodiments of the present invention.

Figure 1:
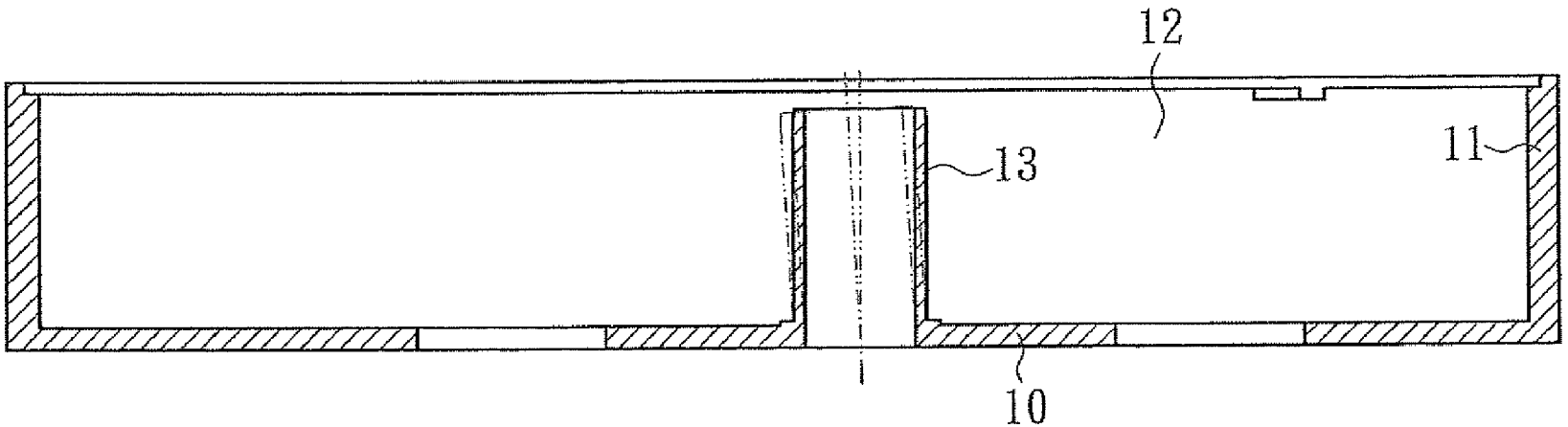
FIG. 1 (PRIOR ART)
FIG. 1 is a cross-sectional view showing a conventional cooling structure.
Figure 2:
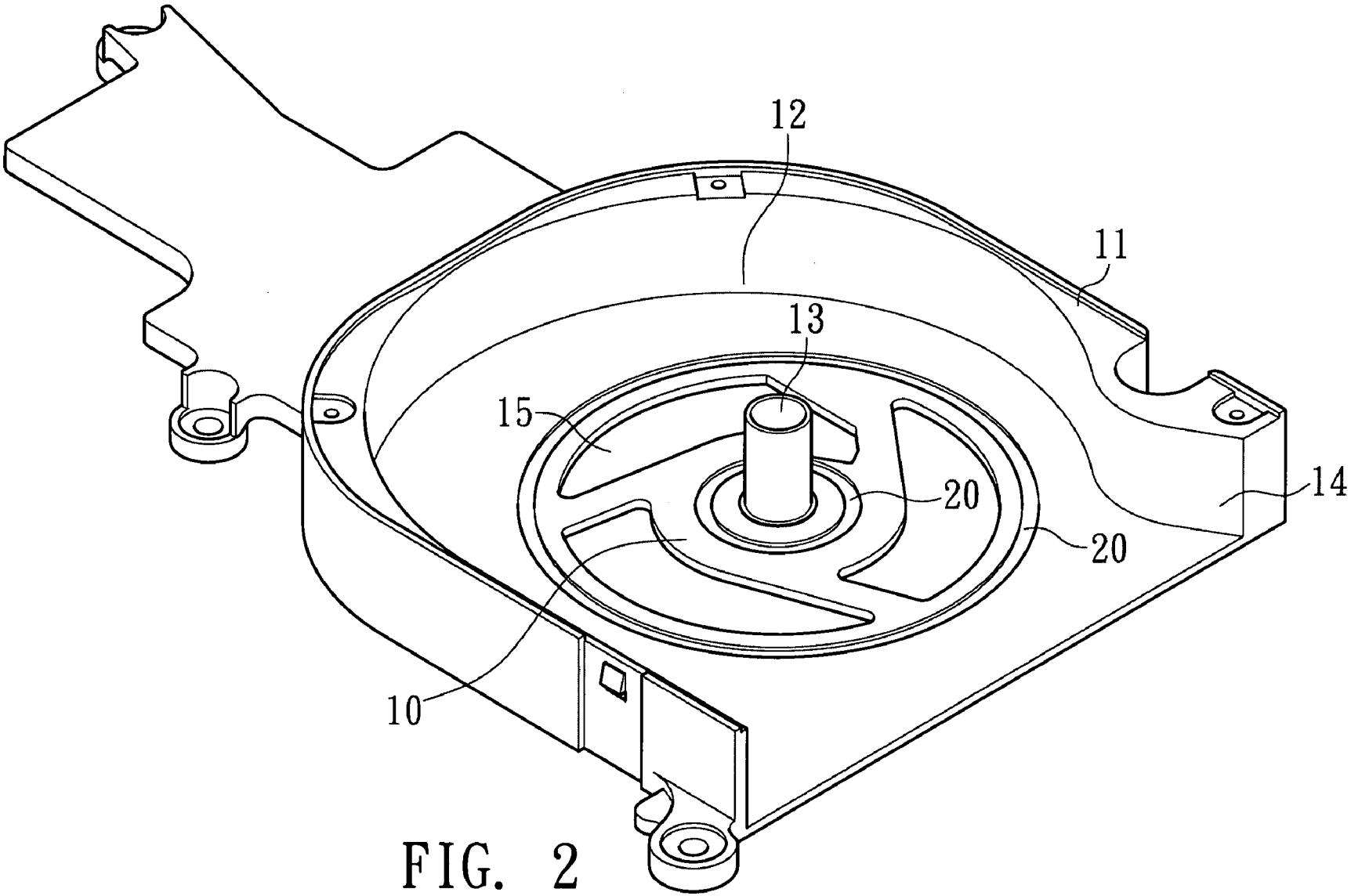
FIG. 2 is an external schematic view showing a first preferred embodiment of the present invention.
Figure 3:
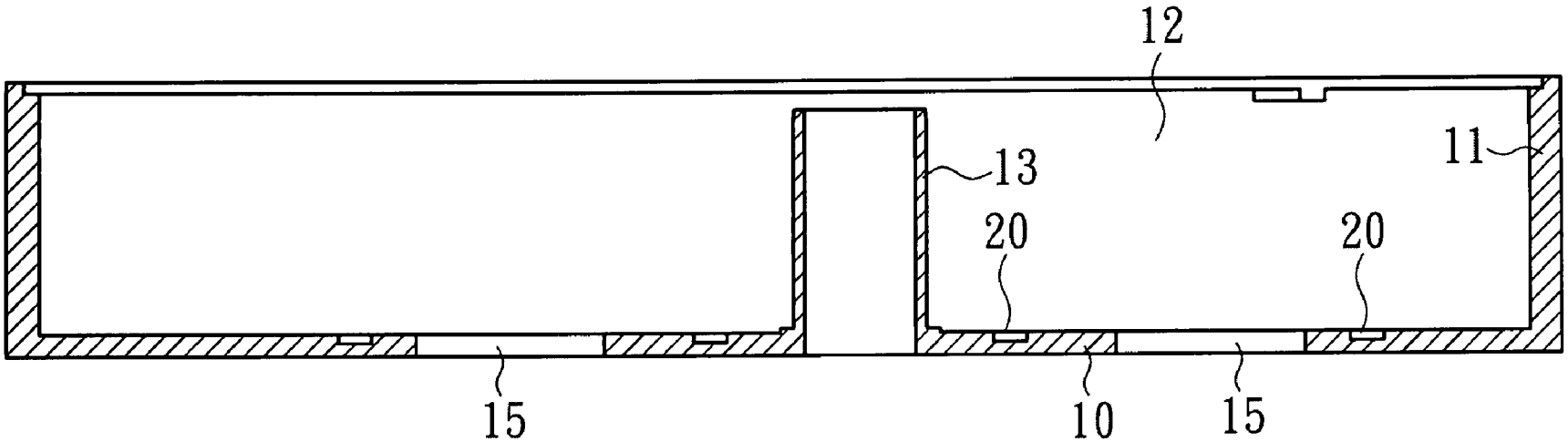
FIG. 3 is a cross-sectional view showing the first preferred embodiment of the present invention.

As shown in FIG. 2. and FIG. 3, a first preferred embodiment of the present invention includes a base 10, in which a containing space 12 is surrounded by a side wall 11 on the periphery of the base excluding an air outlet side 14, an impeller and a stator set (not shown in FIGS. 2 & 3) and a shaft tube 13 are disposed inside the containing space 12, the shaft tube 13 can be assembled or integrally formed on the base 10, and a bearing is placed in a center bore of the shaft tube 13 for supporting a spindle of the impeller to rotate therein.

The base 10 of cooling structure can be in form of a closed-type single-inlet blower or a dual-inlet blower equipped with air inlet holes 15, in which a groove 20 is disposed on the base and is located beyond the reach of an outer diameter of the shaft tube 13.

As illustrated by the first embodiment, the groove 20 is an annular shallow groove disposed on the base 10 to form one face of the containing space 12. The groove 20 can be disposed in a range from the outer diameter of the shaft tube 13 to the air inlet holes and disposed beyond the range of the air inlet holes 15.

Figure 4:
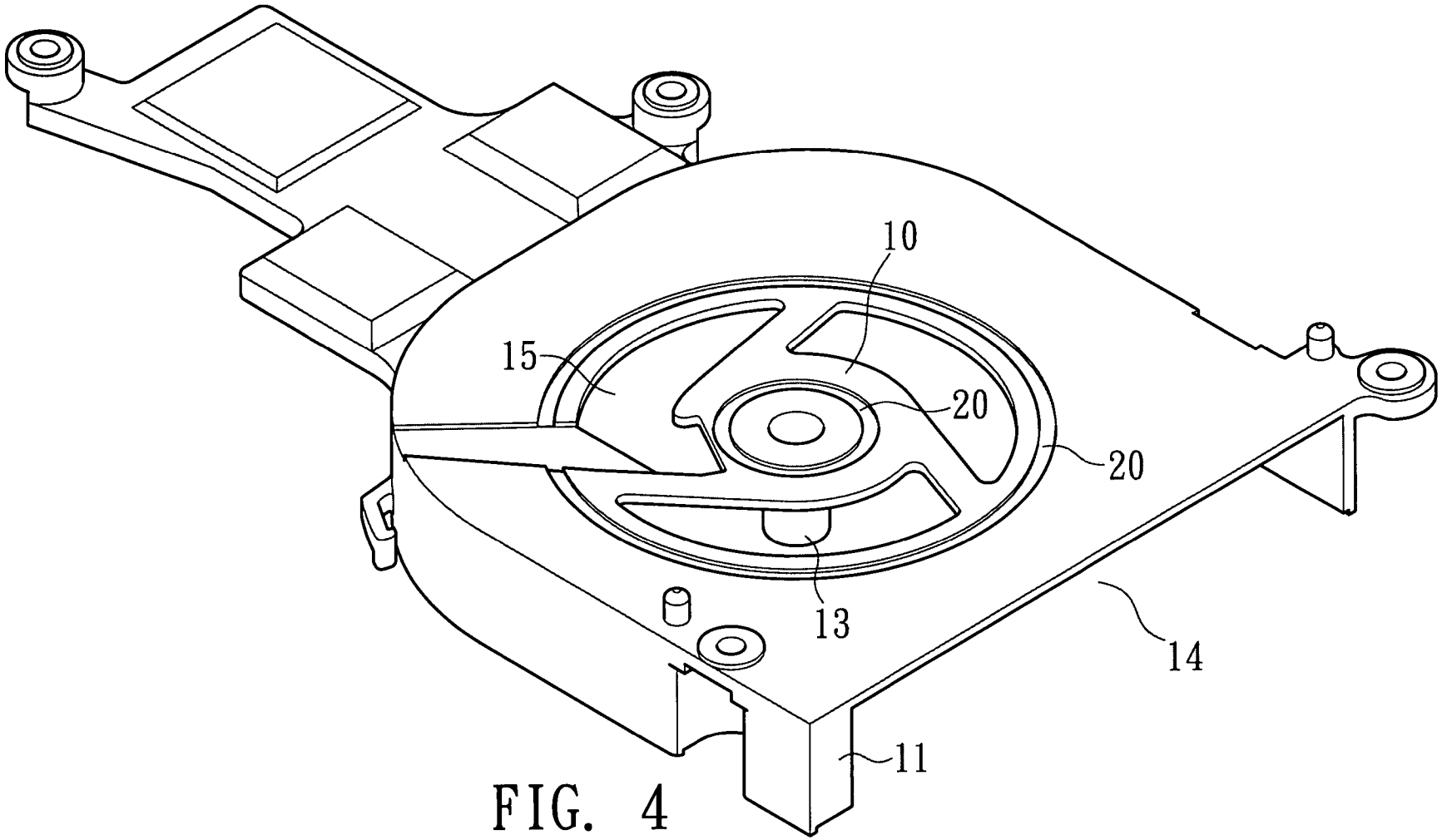
FIG. 4 is an external schematic view showing the second preferred embodiment of the present invention.
Figure 5:
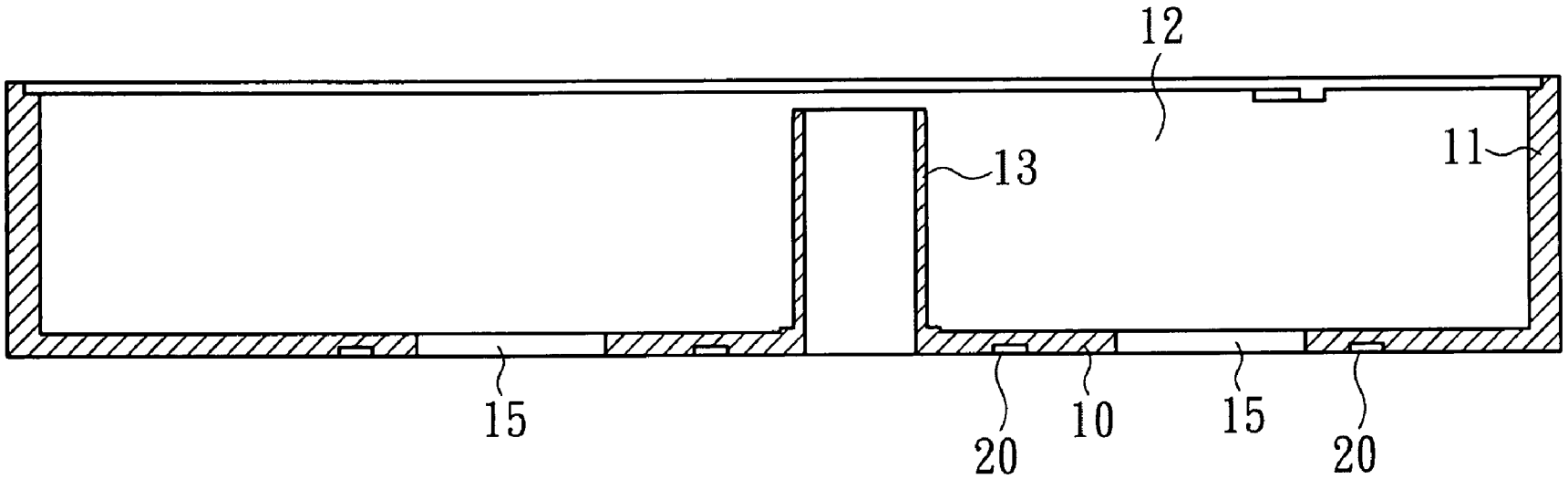
FIG. 5 is a cross-sectional view showing the second preferred embodiment of the present invention.

A second preferred embodiment of the present invention is illustrated in FIG. 4 and FIG. 5. Similarly, a groove 20 is in form of an annular shallow groove and is disposed on the bottom surface of the base 10, and the groove 20 can be disposed in a range from an outer diameter to air inlet holes 15 and disposed beyond the range of the air inlet holes 15.

Figure 6:
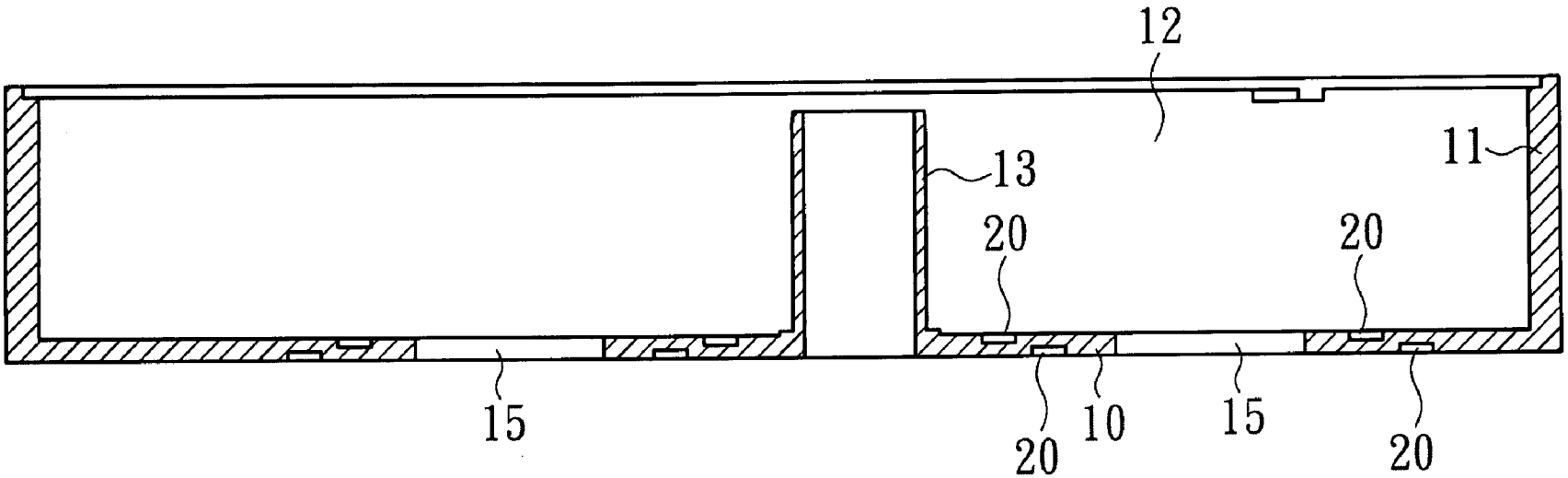
FIG. 6 is a cross-sectional view showing a third preferred embodiment of the present invention.

A third preferred embodiment is illustrated in FIG. 6. An annular groove 20 can be disposed on a top side and a bottom side of the base 10 respectively, disposed in a range from an outer diameter of a shaft tube 13 to air inlet holes 15 and disposed beyond the range of the air inlet holes 15.

Figure 7:
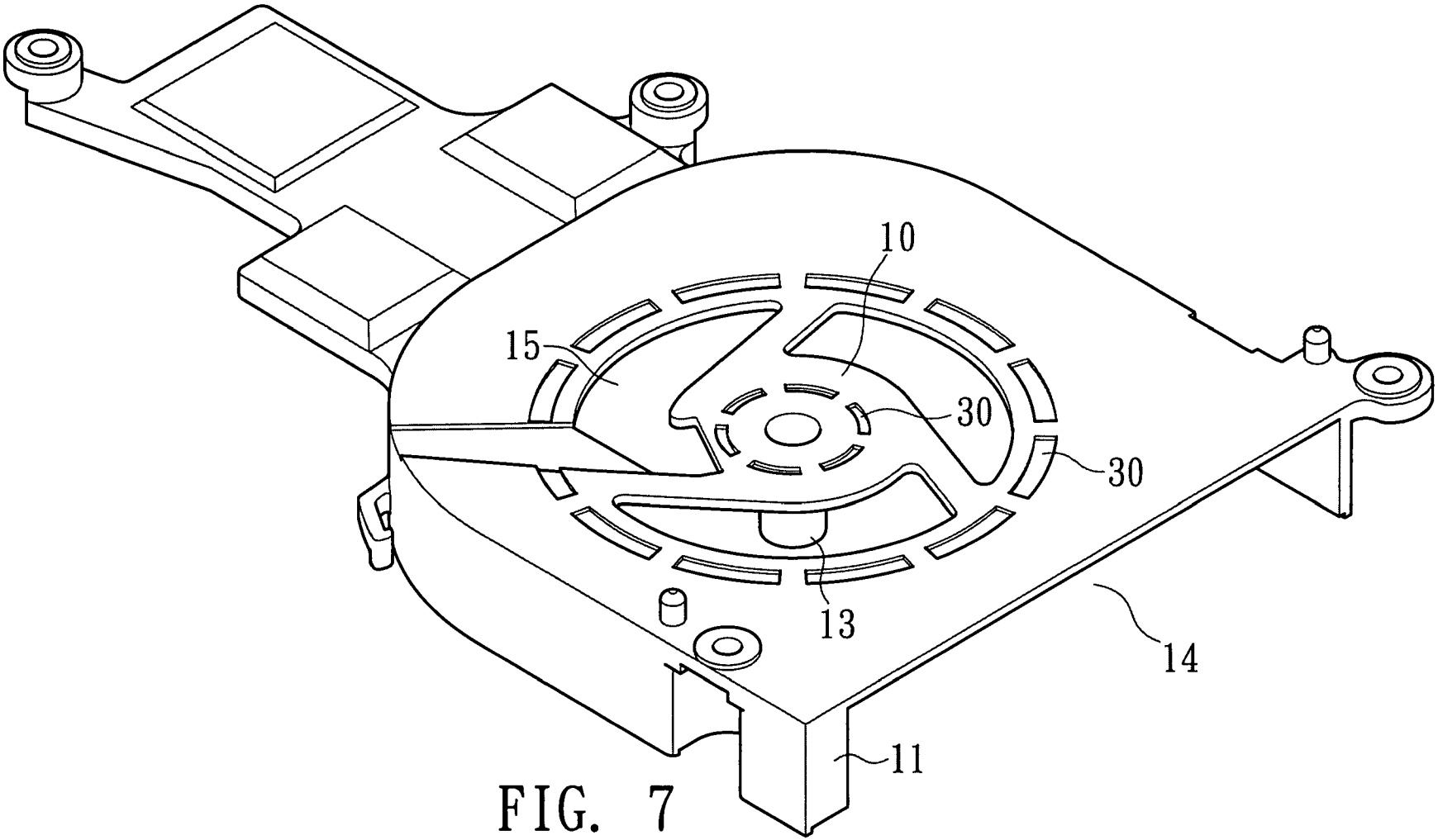
FIG. 7 is an external schematic view showing a fourth preferred embodiment of the present invention.

Furthermore, a fourth preferred embodiment of the present invention is illustrated in FIG. 7. A groove 30 of this pattern is constituted by arranging a plurality of long-strip-like shallow grooves as a ring, can be selectively disposed on the top side and the bottom side of the base 10 respectively or on either one, can be disposed in a range from an outer diameter of a shaft tube 13 to air inlet holes 15 and can be disposed beyond the range of the air inlet holes 15.

Figure 8:
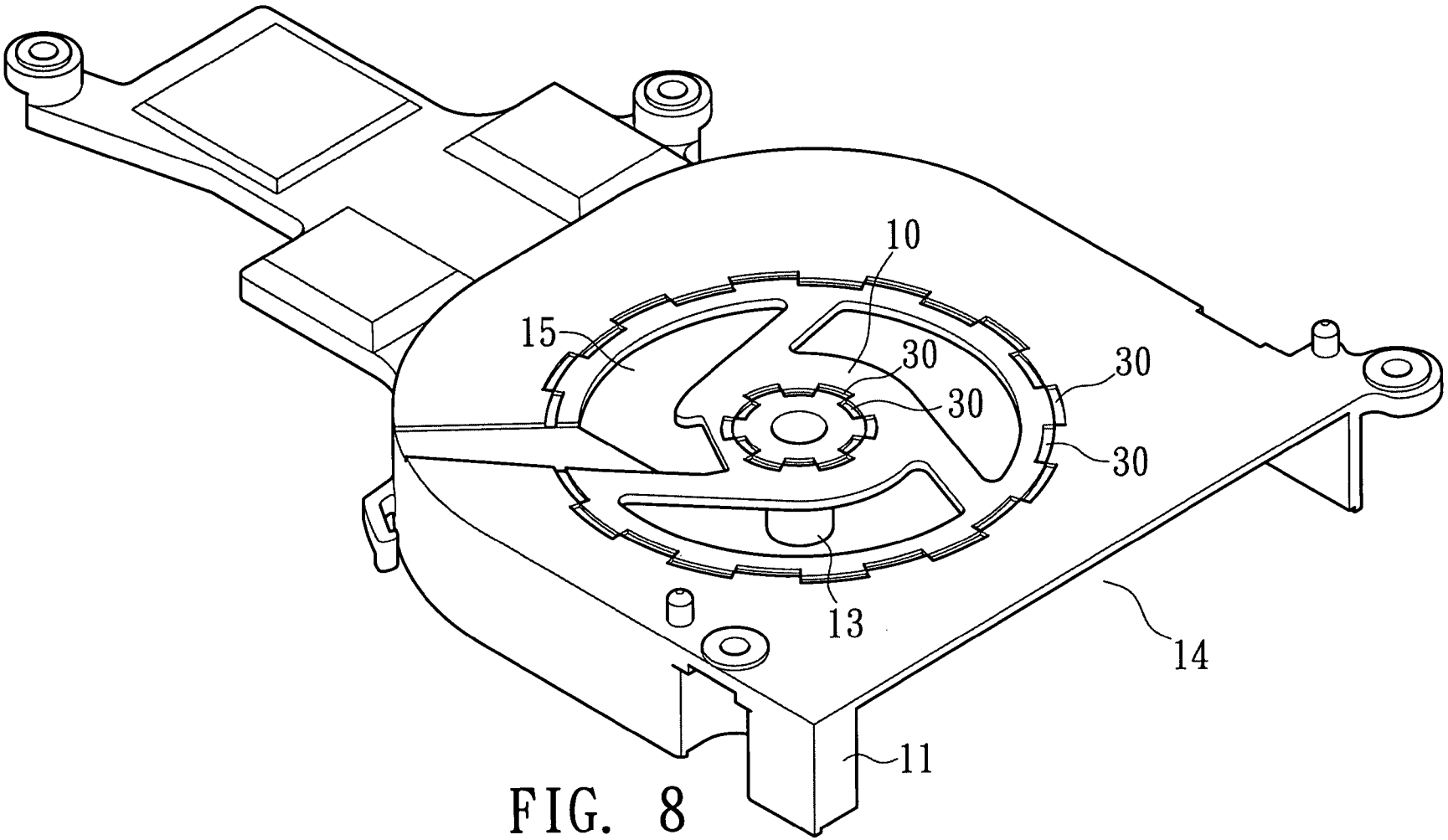
FIG. 8 is an external schematic view showing a fifth preferred embodiment of the present invention.

A fifth preferred embodiment of the present invention is illustrated in FIG. 8. A groove 30 of this pattern is constituted by arranging a plurality of long-strip-like shallow grooves to form at least two rings, can be selectively disposed on both the top side and the bottom side of the base 10 or on either one, can be disposed in a range from an outer diameter of a shaft tube 13 to air inlet holes 15 and can be disposed beyond the range of the air inlet holes 15.

Figure 9:
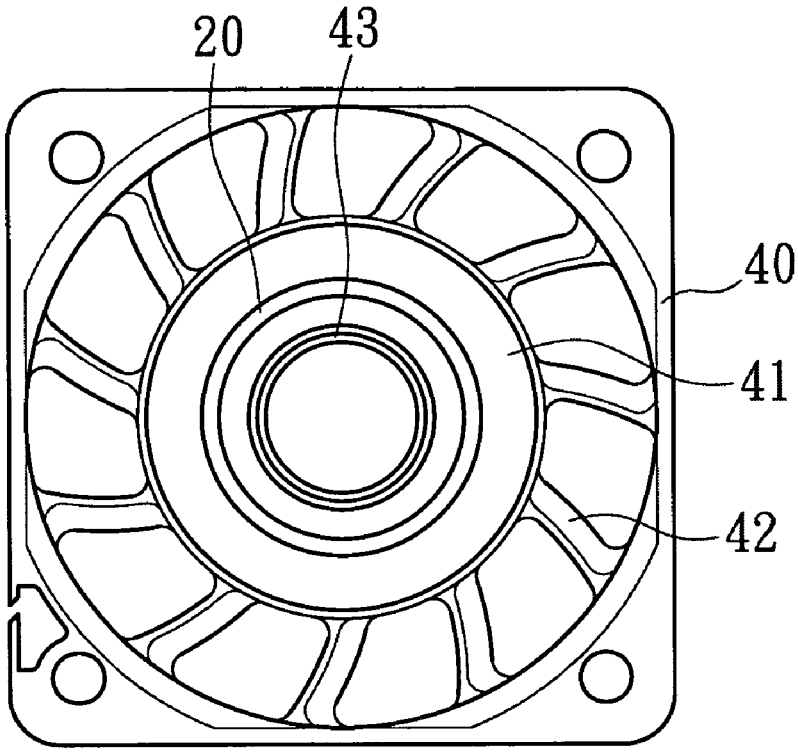
FIG. 9 is a plane view showing a sixth preferred embodiment of the present invention.
Figure 10:
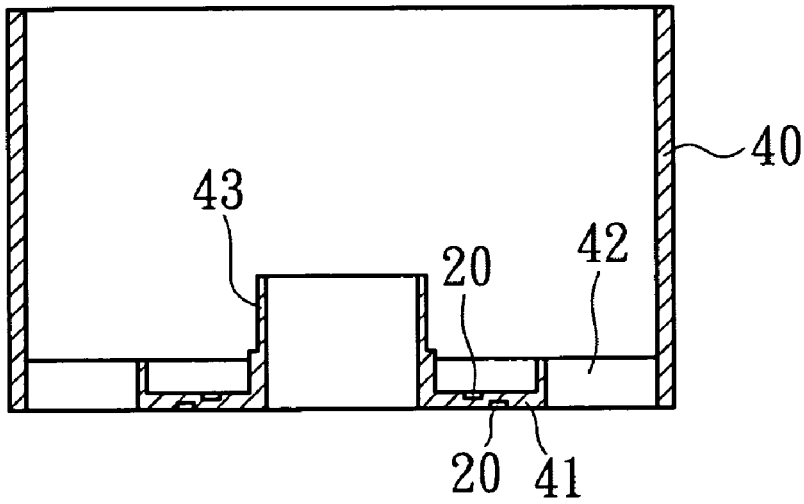
FIG. 10 is a cross-sectional view showing the sixth preferred embodiment of the present invention.

As shown in FIG. 9 and FIG. 10, a sixth preferred embodiment of the present invention is an axial flow cooling structure, in which its frame 40 has a base 41 therein, the base 41 is connected with the frame 40 by a plurality of ribs 42, a shaft tube 43 is formed on the base 41 and can be assembled or integrally formed on the base 41, grooves 20 are disposed on the base 41, located beyond the reach of an outer diameter of the shaft tube 43 and selectively disposed on both a top and a bottom sides of the base 41 or on either one.

In contrast to the aforementioned structure, the characteristics of the present invention at least include:

no slanted shaft tube: The present invention provides a groove beyond the outer diameter of the shaft tube on the base, employs the groove design to effectively prevent the non-uniform contraction stress caused by difference of cooling time and temperature and to prevent the impact of the thermal contraction stress on the vertical alignment precision of the center line of the shaft tube, so as to avoid a slanted shaft tube.

smooth impeller operation and no issue of run-out and noise: When the shaft tube can maintain its original vertical alignment precision and further support stable rotation of the spindle of impeller, the issues of run-out and noise certainly won't occur.

reduced product defective rate: When rotation of the impeller is smooth and there're no issues of run-out and noise, vibration of the product and the noise test value comply with a standard value range so as to lower the defective rate of the product.

long lifespan: When rotation of the impeller is smooth and there're no issues of run-out and noise, a normal operational lifespan of the cooling structure can certainly be maintained.

In sum, from the above-mentioned characteristics those features not only has a novelty among similar products and a progressiveness, but also has an industry utility While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A base design of a cooling structure, comprising:

a base;

a shaft tube disposed on said base;

a bearing placed in a center bore of said shaft tube for supporting a spindle of an impeller to rotate therein; and at least a groove disposed on said base and located beyond an outer diameter of said shaft tube wherein said groove pertains to an annular shallow groove wherein said groove is disposed on a top and a bottom side of said base respectively.

2. The base design of a cooling structure of claim 1, wherein said groove is selectively disposed on one of a top side and a bottom side.

3. The base design of a cooling structure of claim 1, wherein said groove is formed by arranging a plurality of long-strip-like shallow grooves as a ring.

4. The base design of a cooling structure of claim 1, wherein said groove is formed by alternately arranging a plurality of long-strip-like shallow grooves to form at least two rings.

5. The base design of a cooling structure of claim 1, wherein said base is selectively chosen from a group consisting of a closed-type single-inlet blower and a dual-inlet blower with a plurality of air inlet holes.

6. The base design of a cooling structure of claim 5, wherein said groove is located in a range from said outer diameter of said base to said plural air inlet holes.

7. The base design of a cooling structure of claim 5, wherein said groove is located beyond said plural air inlet holes.

8. The base design of a cooling structure of claim 1, wherein said cooling structure pertains to an axial flow fan.

9. A base design of a cooling structure, comprising:

a base;

a containing space surrounded by a side wall on a periphery of said base excluding an air outlet side for forming a blower;

a shaft tube disposed on said base;

a bearing placed in a center bore of said shaft tube for supporting a spindle of an impeller to rotate therein; and at least a groove disposed on said base and located beyond an outer diameter of said shaft tube wherein said groove pertains to an annular shallow groove wherein said groove is disposed on a top side and a bottom side of said base respectively.

10. The base design of a cooling structure of claim 9, wherein said groove is selectively disposed on one of a top side and a bottom side.

11. The base design of a cooling structure of claim 9, wherein said groove is formed by arranging a plurality of long-strip-like shallow grooves as a ring.

12. The base design of a cooling structure of claim 9, wherein said groove is formed by alternately arranging a plurality of long-strip-like shallow grooves to form at least two rings.

13. The base design of a cooling structure of claim 9, wherein said base is selectively chosen from a group consisting of a closed-type single-inlet blower and a dual-inlet blower with a plurality of air inlet holes.

14. The base design of a cooling structure of claim 13, wherein said groove is located in a range from said outer diameter of said base to said plural air inlet holes.

15. The base design of a cooling structure of claim 13, wherein said groove is located beyond said plural air inlet holes.

16. A base design of a cooling structure, comprising:

a base located inside a frame;

a plurality of ribs connected with said base and said frame to form an axial flow fan;

a shaft tube disposed on said base;

a bearing placed in a center bore of said shaft tube for supporting a spindle of an impeller to rotate therein; and at least a groove disposed on said base and located beyond an outer diameter of said shaft tube wherein said groove pertains to an annular shallow groove wherein said groove is disposed on a top side and a bottom side of said base respectively.

17. The base design of a cooling structure of claim 16, wherein said groove is selectively disposed on one of a top side and a bottom side.

18. The base design of a cooling structure of claim 16, wherein said groove is formed by arranging a plurality of long-strip-like shallow grooves as a ring.

19. The base design of a cooling structure of claim 16, wherein said groove is formed by alternately arranging a plurality of long-strip-like shallow grooves to form at least two rings.

* * * * *